US007121959B1

(12) United States Patent
Yoshida et al.

(10) Patent No.: US 7,121,959 B1
(45) Date of Patent: Oct. 17, 2006

(54) MULTI-PIECE SOLID GOLF BALL

(75) Inventors: Kazunari Yoshida, Kasai (JP); Keiji Moriyama, Akashi (JP); Satoshi Iwami, Akashi (JP); Keiji Ohama, Akashi (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 09/551,871

(22) Filed: Apr. 18, 2000

(30) Foreign Application Priority Data

Apr. 19, 1999 (JP) ..... 11/110809

(51) Int. Cl.

| | |
|---|---|
| ***A63B 37/04*** | (2006.01) |
| ***A63B 37/06*** | (2006.01) |
| ***A63B 37/00*** | (2006.01) |
| *A63B 37/12* | (2006.01) |

(52) U.S. Cl. ..... 473/371; 473/351

(58) Field of Classification Search ..... 473/351, 473/353, 356, 357, 359, 361, 362, 363, 365, 473/367, 370, 373, 374, 378

See application file for complete search history.

(56) References Cited

U.S. PATENT DOCUMENTS

| | | | | |
|---|---|---|---|---|
| 4,483,537 | A * | 11/1984 | Hanada et al. | 473/372 |
| 5,002,281 | A | 3/1991 | Nakahara et al. | |
| 5,184,828 | A * | 2/1993 | Kim et al. | 473/374 |
| 5,556,098 | A | 9/1996 | Higuchi et al. | |
| 5,702,312 | A * | 12/1997 | Horiuchi et al. | 473/377 |
| 5,711,723 | A | 1/1998 | Hiraoka et al. | |
| 5,830,085 | A | 11/1998 | Higuchi et al. | |
| 6,045,459 | A * | 4/2000 | Sugimoto et al. | 473/373 |
| 6,117,026 | A * | 9/2000 | Hayashi et al. | 473/374 |
| 6,129,640 | A * | 10/2000 | Higuchi et al. | 473/374 |
| 6,190,269 | B1 * | 2/2001 | Moriyama | 473/373 |
| 6,336,872 | B1 * | 1/2002 | Moriyama et al. | 473/374 |

FOREIGN PATENT DOCUMENTS

| | | |
|---|---|---|
| GB | 313789 | 12/1997 |
| GB | 321602 | 8/1998 |
| JP | 448473 | 12/1986 |

(Continued)

OTHER PUBLICATIONS

Farrally et al. "Material Selection for Non-wound cores," Science and Golf III. Illinois: Human Kinetics, copyright 1999, p. 411-412.*

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

The invention provides a multi-piece solid golf ball having soft, good shot feel, excellent flight performance, high rebound characteristics and high launch angle, when hit by golfers who swing a golf club at high or low head speed using all golf clubs, namely, a driver to an iron club, a putter. The multi-piece solid golf ball has a core having an inner core and an outer core covering the inner core, and at least one layer covering the core; the inner core has a diameter of 30 to 40.4 mm and surface hardness of 60 to 85 JIS-C, and center JIS-C hardness of the inner core lower than the surface hardness by 5 to 30; the outer core has a thickness of 0.2 to 1.3 mm, and a surface JIS-C hardness of the outer core lower than the surface hardness of the inner core by 2 to 30.

34 Claims, 2 Drawing Sheets

FOREIGN PATENT DOCUMENTS

| | | |
|---|---|---|
| JP | 228978 | 9/1990 |
| JP | 724084 | 1/1995 |
| JP | 332247 | 12/1996 |
| JP | 313643 | 12/1997 |
| JP | 322948 | 12/1997 |
| JP | 216271 | 8/1998 |

* cited by examiner

MULTI-PIECE SOLID GOLF BALL

FIELD OF THE INVENTION

The present invention relates to a multi-piece solid golf ball. More particularly, it relates to a multi-piece solid golf ball having very soft and good shot feel when hit by golfers who swing a golf club at high or low head speed using all golf clubs such as a driver to an iron club, a putter, and having excellent flight performance when hit by a golfer who swings a golf club at low head speed, by accomplishing high rebound characteristics and high launch angle.

BACKGROUND OF THE INVENTION

In the history of golf balls, a thread wound golf ball was firstly developed. The thread wound golf ball is obtained by winding thread rubber in a stretched state on a solid or liquid center to form a thread wound core and covering it with a cover of balata, etc. having a thickness of 1 to 2 mm.

A two-piece solid golf ball was subsequently developed, which was composed of a core formed from integrally molded rubber material and a thermoplastic resin cover (e.g. ionomer resin cover) formed on the core. The two-piece solid golf ball is easily produced because of simple structure, and has excellent rebound characteristics and excellent durability. Therefore, the two-piece solid golf ball is generally approved or employed by many golfers, mainly amateur golfers. However, the two-piece solid golf ball exhibits harder and poorer shot feel at the time of hitting than the thread wound golf ball.

In order to provide a two-piece solid golf ball having a shot feel as good as the thread wound golf ball, a soft type two-piece solid golf ball using a softer core has been proposed. However, the use of the soft core adversely affects on rebound characteristics, thus resulting in a reduction in flight distance and a deterioration in durability.

It has been proposed to place an intermediate layer between the core and the cover of the two-piece solid golf ball to form a three-piece solid golf ball so as to maintain the balance between flight performance and shot feel at the time of hitting. The three-piece solid golf ball generally occupies the greater part of the golf ball market. The three-piece solid golf ball are classified into two types, depending on whether the intermediate layer is formed from rubber material or thermoplastic resin.

For example, a three-piece solid golf ball comprising a two-piece core composed of a core and an intermediate layer, which is formed from vulcanized rubber material having the same composition as the core, is suggested in Japanese Patent Kokai publication Nos. 228978/1990, 332247/1996, 322948/1997, 216271/1998 and the like. These golf balls are characterized by controlling the thickness of the intermediate layer to not less than 1.5 mm, which is relatively thick, and they are classified into two types depending on whether the intermediate layer is harder or softer than the inner core.

In the three-piece solid golf balls described in Japanese Patent Kokai publication Nos. 228978/1990 and 332247/1996, of which the intermediate layer is harder than the inner core, the flight performance is excellent, but the shot feel is poor, because the intermediate layer is thick and hard. Therefore, the golf balls have very soft core in order to accomplish soft and good shot feel. However, in the golf balls, the shot feel when hit by golfers who swing the golf club at low head speed is hard and poor, if the shot feel when hit by golfers who swing the golf club at high head speed is designed to be soft and good. On the other hand, the shot feel when hit by golfers who swing the golf club at high head speed is heavy and poor, if the shot feel when hit by golfers who swing the golf club at low head speed is designed to be soft and good. The golf balls have hard and poor shot feel when hit by a short iron club or putter, if the shot feel when hit by a driver is designed to be soft and good. In addition, the golf balls generally have poor durability.

In the three-piece solid golf balls described in Japanese Patent Kokai publication Nos. 322948/1997 and 216271/1998, of which the intermediate layer is softer than the inner core, the rebound characteristics are largely degraded, which reduces the flight distance when hit particularly by golfers who swing the golf club at low head speed.

Three-piece solid golf balls, of which the intermediate layer is formed from thermoplastic resin, is suggested in Japanese Patent Kokai publication Nos. 313643/1997 and 24084/1995, Japanese Patent Kokoku publication No. 48473/1992 and the like. In the golf balls, the golf ball described in Japanese Patent Kokai publication Nos. 313643/1997, of which the intermediate layer is harder than the inner core, has soft and good shot feel when hit by all golfers who swing at high and low head speed, but has poor shot feel when hit by a short iron club to a putter, when compared with the three-piece solid golf ball having hard type intermediate layer formed from the above vulcanized-rubber.

In the golf balls described in Japanese Patent Kokai publication No. 24084/1995 and Japanese Patent Kokoku publication No. 48473/1992, of which the intermediate layer is softer than the inner core, it is restrained to degrade the rebound characteristics when compared with the three-piece solid golf ball having soft type intermediate layer formed from the above vulcanized rubber. The golf balls have good shot feel when hit by a short iron club to a putter, when compared with the three-piece solid golf ball having hard type intermediate layer formed from the thermoplastic resin. However, since the deformation amount at a portion nearby the surface of the golf ball is large, the area contacted with the golf club, which reduces the spin amount, and the flight distance is long, when compared with the three-piece solid golf ball having hard type intermediate layer formed from the thermoplastic resin. In addition, the shot feel when hit by golfers who swing the golf club at high head speed is heavy and poor.

There has been the case that the conventional three-piece solid golf ball, which has excellent performance for golfers who swing the golf club at high head speed, is not suitable for golfers who swing the golf club at low head speed. On the other hand, there has been the case that the conventional three-piece solid golf ball, which has excellent performance for golfers who swing the golf club at low head speed, is not suitable for golfers who swing the golf club at high head speed. There has been no golf ball, which is suitable for all golfers who swing the golf club at high or low head speed. There has been problem that the conventional three-piece solid golf ball, which has long flight distance and is suitable for golfers who swing the golf club at low head speed, has hard and poor shot feel when hit by an iron club or putter.

OBJECTS OF THE INVENTION

A main object of the present invention is to provide a multi-piece solid golf ball having soft and good shot feel, and having excellent flight performance, by accomplishing high rebound characteristics and high launch angle, when hit by golfers who swing a golf club at high or low head speed using all golf clubs, that is, a driver to an iron club, a putter.

According to the present invention, the object described above has been accomplished by adjusting the diameter, center hardness and hardness distribution of the inner core, the thickness and surface hardness of the outer core, the hardness distribution of the core to a specified range, thereby providing a multi-piece solid golf ball having soft and good shot feel, and having excellent flight performance, by accomplishing high rebound characteristics and high launch angle, when hit by golfers who swing a golf club at high or low head speed using all golf clubs, that is, a driver to an iron club, a putter.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

The present invention provides a multi-piece solid golf ball comprising a core consisting of an inner core and an outer core formed on the inner core, and one or more layers of cover covering the core, wherein the inner core has a diameter of 30 to 40.4 mm and a surface hardness in JIS-C hardness of 60 to 85, and a center hardness in JIS-C hardness of the inner core is lower than the surface hardness by 5 to 30, the outer core has a thickness of 0.2 to 1.3 mm, and a surface hardness in JIS-C hardness of the outer core is lower than the surface hardness of the inner core by 2 to 30.

In order to practice the present invention suitably, it is preferable that the outermost layer of the cover have a thickness of 1.0 to 3.0 mm and a surface hardness in Shore D hardness of 58 to 75, and the outer core have a thickness of 0.2 to 0.9 mm.

DETAILED DESCRIPTION OF THE INVENTION

Figure 1:
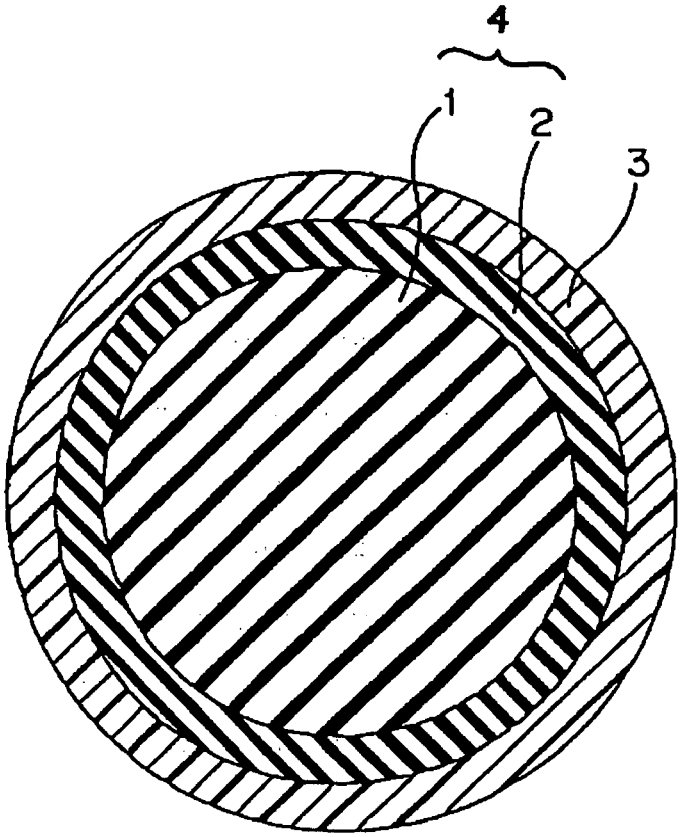
FIG. 1 is a schematic cross section illustrating one embodiment of the golf ball of the present invention.

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 4 consisting of an inner core 1 and an outer core 2 formed on the inner core 1, and one or more layers of cover 3 covering the core 4. In order to explain the golf ball of the present invention simply, a golf ball having one layer of cover 3 will be used hereinafter for explanation. However, the golf ball of the present invention may be applied for the golf ball having two or more layers of cover.

The core 4, including both the inner core 1 and the outer core 2, is obtained from a rubber composition. The rubber composition essentially contains polybutadiene, a co-crosslinking agent, an organic peroxide and a filler.

The polybutadiene used for the core 4 of the present invention may be one, which has been conventionally used for cores of solid golf balls. Preferred is high-cis polybutadiene rubber containing a cis-1,4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), or a blend of the metal salt of α,β-unsaturated carboxylic acid and acrylic ester or methacrylic ester and the like. The preferred co-crosslinking agent for the inner core is zinc acrylate because it imparts high rebound characteristics to the resulting golf ball, and the preferred co-crosslinking agent for the outer core is magnesium methacrylate because it imparts good releasability from a mold to the core. The amount of the co-crosslinking agent is from 5 to 70 parts by weight, preferably from 10 to 50 parts by weight, based on 100 parts by weight of the polybutadiene. When the amount of the co-crosslinking agent is larger than 70 parts by weight, the core is too hard, and the shot feel is poor. On the other hand, when the amount of the co-crosslinking agent is smaller than 5 parts by weight, it is required to increase an amount of the organic peroxide in order to impart a desired hardness to the core. Therefore, the rebound characteristics are degraded, which reduces the flight distance.

The organic peroxide includes, for example, dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.2 to 7.0 parts by weight, preferably 0.5 to 5.0 parts by weight, based on 100 parts by weight of the polybutadiene. When the amount of the organic peroxide is smaller than 0.2 parts by weight, the core is too soft, and the rebound characteristics are degraded, which reduces the flight distance. On the other hand, when the amount of the organic peroxide is larger than 7.0 parts by weight, it is required to decrease an amount of the co-crosslinking agent in order to impart a desired hardness to the core. Therefore, the rebound characteristics are degraded, which reduces the flight distance.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is not limited and can vary depending on the specific gravity and size of the cover and core, but is from 3 to 50 parts by weight, preferably from 10 to 30 parts by weight, based on 100 parts by weight of the polybutadiene. When the amount of the filler is smaller than 3 parts by weight, it is difficult to adjust the weight of the resulting golf ball. On the other hand, when the amount of the filler is larger than 50 parts by weight, the weight ratio of the rubber component in the core is small, and the rebound characteristics reduce too much.

The rubber compositions for the inner core and outer core of the golf ball of the present invention can contain other components, which have been conventionally used for preparing the core of solid golf balls, such as antioxidant or peptizing agent. If used, the amount of the antioxidant is preferably 0.1 to 1.0 parts by weight, and an amount of the peptizing agent is preferably 0.1 to 5.0 parts by weight, based on 100 parts by weight of the polybutadiene.

Figure 2:
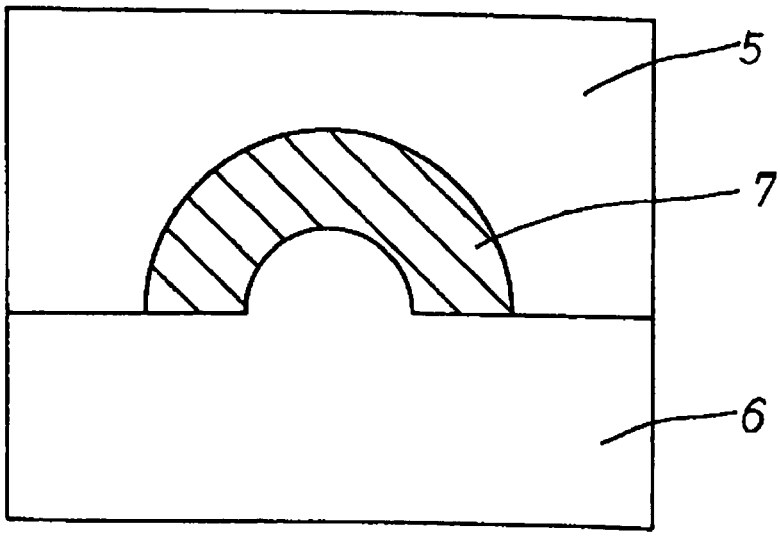
FIG. 2 is a schematic cross section illustrating one embodiment of a mold for molding an outer core of the golf ball of the present invention.
Figure 3:
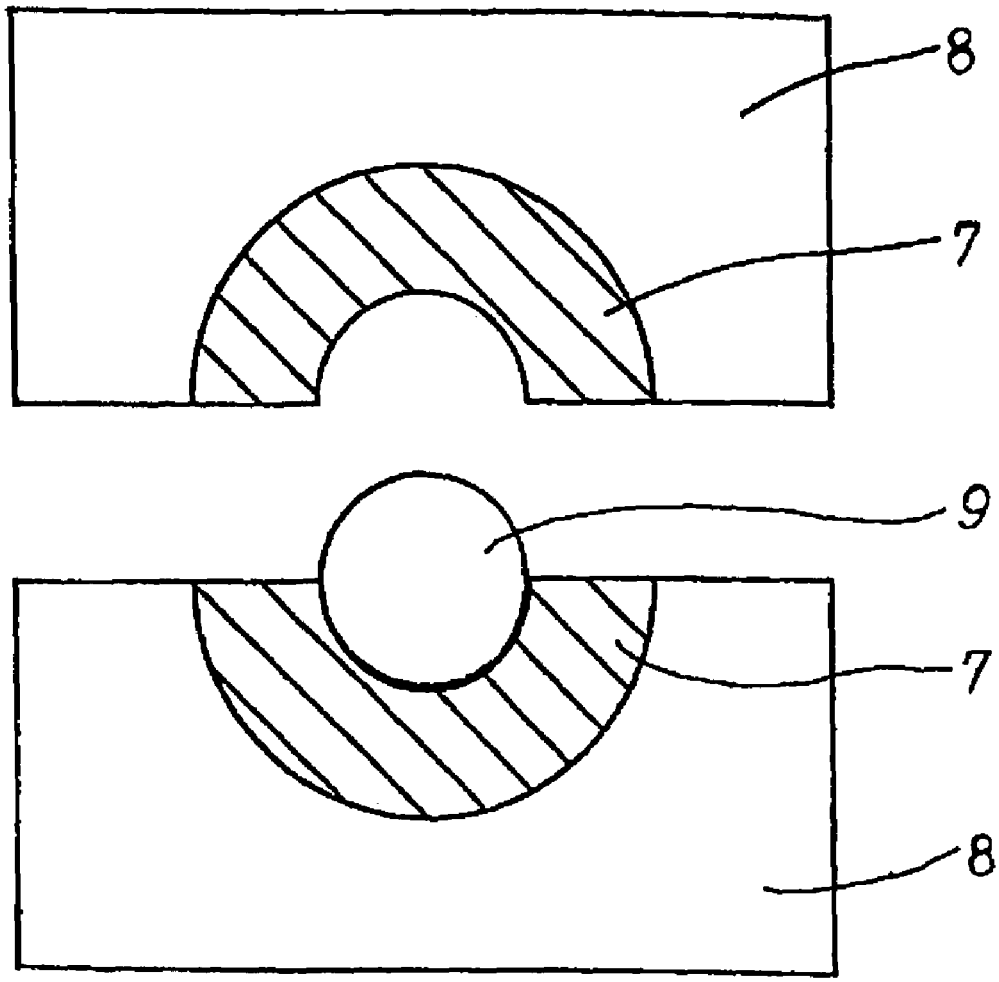
FIG. 3 is a schematic cross section illustrating one embodiment of a mold for molding a core of the golf ball of the present invention.

The process of producing the core of the golf ball of the present invention will be explained with is reference to FIG. 2 and FIG. 3. FIG. 2 is a schematic cross section illustrating one embodiment of a mold for molding an outer core of the golf ball of the present invention. FIG. 3 is a schematic cross section illustrating one embodiment of a mold for molding a core of the golf ball of the present invention. The rubber composition for the inner core is molded by using an extruder to form a cylindrical unvulcanized inner core. The rubber composition for the outer core is then vulcanized by press-molding, for example, at 120 to 160° C. for 2 to 30 minutes using a mold having a semi-spherical cavity 5 and a male plug mold 6 having a semi-spherical convex having the same shape as the inner core as described in FIG. 2 to obtain a vulcanized semi-spherical half-shell 7 for the outer core. The unvulcanized inner core 9 is covered with the two vulcanized semi-spherical half-shells 7 for the outer core, and then vulcanized by integrally press-molding, for example, at 140 to 180° C. for 10 to 60 minutes in a mold 8 for molding a core, which is composed of an upper mold and a lower mold, as described in FIG. 3 to obtain the core 4. The core 4 is composed of the inner core 1 and the outer core 2 formed on the inner core.

In the golf ball of the present invention, the inner core 1 has a diameter of 30 to 40.4 mm, preferably 34.2 to 39.4 mm, more preferably 35.6 to 38.6 mm. When the diameter of the inner core is smaller than 30 mm, it is required to increase the thickness of the outer core or the cover to a thickness more than a desired thickness. Therefore, the rebound characteristics are degraded, or the shot feel is hard and poor. On the other hand, when the diameter of the inner core is larger than 40.4 mm, it is required to decrease the thickness of the outer core or the cover to a thickness less than a desired thickness. Therefore the technical effect accomplished by the presence of the outer core is not sufficiently obtained.

In the golf ball of the present invention, it is required that the inner core 1 have a surface hardness in JIS-C hardness of 60 to 85, preferably 70 to 84, more preferably 72 to 82. When the hardness is smaller than 60, the shot feel is heavy and poor, and the inner core is too soft, and the rebound characteristics are degraded, which reduces the flight distance. On the other hand, when the hardness is larger than 85, the inner core is too hard, and the shot feel is hard and poor.

In the golf ball of the present invention, it is required that a center hardness in JIS-C hardness of the inner core is lower than the surface hardness by 5 to 30, preferably 6 to 20, more preferably 7 to 15. When the hardness difference is smaller than 5, the shot feel is hard and poor, and the launch angle is small, which reduces the flight distance. When the hardness difference is larger than 30, the shot feel is heavy and poor, and the rebound characteristics are degraded, which reduces the flight distance.

It is desired that the inner core has the center hardness in JIS-C hardness of 50 to 80, preferably 60 to 75. When the hardness is smaller than 50, the shot feel is heavy and poor, and the inner core is too soft and the rebound characteristics are degraded, which reduces the flight distance. On the other hand, when the hardness is larger than 80, the shot feel is hard and poor, and the rebound characteristics are sufficiently obtained, but the launch angle is small, which reduces the flight distance.

The center hardness of the inner core is determined by measuring a hardness at the center point of the inner core in section, after the core, which is formed by integrally press-molding the inner core and the outer core, is cut into two equal parts. The surface hardness of the inner core as used herein is determined by measuring a hardness at the surface of inner the core, after removing the outer core 2 from the core to expose the inner core 1.

In the golf ball of the present invention, the outer core 2 has a thickness of 0.2 to 1.3 mm, preferably 0.2 to 0.9 mm, more preferably 0.3 to 0.8 mm. When the thickness is smaller than 0.2 mm, the technical effect accomplished by the presence of the outer core is not sufficiently obtained, and the shot feel is hard and poor, and the launch angle is small, which reduces the flight distance. On the other hand, when the thickness is larger than 1.3 mm, the shot feel is heavy and poor, and the rebound characteristics are degraded. In addition, the area contacted with the golf club is large, which reduces the flight distance, because the deformation amount at the time of hitting is large.

In the present invention, it is required that the surface hardness of the outer core 2 is lower than the surface hardness of the inner core 1 by 2 to 30, preferably 4 to 20, more preferably 5 to 15. When the hardness difference is smaller than 2, the shot feel is hard and poor, particularly the shot feel when hit by a short iron club and putter is poor. On the other hand, when the hardness difference is larger than 30, the rebound characteristics are degraded. In addition, the deformation amount at the time of hitting is large, and the spin amount is large, which reduces the flight distance.

In the golf ball of the present invention, it is desired that the outer core 2 have a surface hardness in JIS-C hardness of 83 to 50, preferably 80 to 60. When the surface hardness is smaller than 50, the launch angle is small, and the rebound characteristics are degraded, which reduces the flight distance. On the other hand, when the surface hardness is larger than 83, the outer core is too hard, and the shot fell is poor. As used herein, the term "a surface hardness of the outer core" means the surface hardness of the core having a two-layered structure, which is formed by integrally press-molding the inner core and the outer core.

In the golf ball of the present invention, the outer core 2 is preferably formed by press-molding the rubber composition as used in the inner core 1, which essentially contains polybutadiene, a co-crosslinking agent, an organic peroxide and a filler. Since the outer core 2, which is not formed from thermoplastic resin, such as ionomer resin, thermoplastic elastomer, diene copolymer and the like, is formed from the press-molded article of the rubber composition, the rebound characteristics are improved. When the outer core is formed from thermoplastic resin, the outer core can be prepared by injection molding. However, it is difficult to prepare the outer core 2 of the present invention by injection molding, because the outer core 2 has a thickness of 0.2 to 1.3 mm, which is very thin.

Since the inner core 1 and the outer core 2 are formed from the same vulcanized rubber composition, the adhesion between the inner core 1 and the outer core 2 is excellent, and the durability is improved. Rubber, when compared with resin, has a little deterioration of performance at low temperature lower than room temperature as known in the art, and thus the outer core of the present invention formed from the rubber has excellent rebound characteristics at low temperature.

One or more layers of cover 3 are then covered on the core 4. In the golf ball of the present invention, the cover 3 preferably has single-layer structure, that is, a three-piece solid golf ball, in view of productivity, but the cover may have multi-layer structure, which has two or more layers.

It is desired that the outermost layer of the cover 3 have a thickness of 1.0 to 3.0 mm, preferably 1.5 to 2.4 mm. When the thickness is smaller than 1.0 mm, the rebound characteristics are degraded, which reduces the flight distance. On the other hand, when the thickness is larger than 3.0 mm, the shot feel is hard and poor. In the golf ball of the present invention, it is desired that the outermost layer of the cover 3 have a surface hardness in Shore D of 58 to 75, preferably 63 to 75, more preferably 66 to 75. When the hardness is smaller than 58, the spin amount is large, and the rebound characteristics are degraded, which reduces the flight distance. On the other hand, when the hardness is larger than 75, the shot feel is hard and poor. The cover hardness as used herein is determined by measuring a hardness at the surface of the golf ball, which is obtained by covering the core having a two-layered structure with the cover.

The cover 3 of the present invention contains thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum ion, a tin ion, a zirconium ion, cadmium ion, and the like. Preferred are sodium ions, zinc ions, magnesium ions and the like, in view of rebound characteristics, durability and the like The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover 3 of the present invention, the above ionomer resin may be used alone, but the ionomer resin may be used in combination with at least one of thermoplastic elastomer, diene block copolymer and the like.

Examples of the thermoplastic elastomers include polyamide thermoplastic elastomer, which is commercially available from Toray Co., Ltd. under the trade name of "Pebax" (such as "Pebax 2533"); polyester thermoplastic elastomer, which is commercially available from Toray-Do Pont Co., Ltd. under the trade name of "Hytrel" (such as "Hytrel 3548", "Hytrel 4047"); polyurethane elastomer, which is commercially available from Takeda Verdishe Co., Ltd. under the trade name of "Elastoran" (such as "Elastoran ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010") and the like.

The amount of the thermoplastic elastomer or diene block copolymer is 1 to 60 parts by weight, preferably 1 to 35 parts by weight, based on 100 parts by weight of the base resin for the cover. When the amount is smaller than 1 parts by weight, the technical effect of absorbing the impact force at the time of hitting accomplishing by using them is not sufficiently obtained. On the other hand, when the amount is larger than 60 parts by weight, the cover is too soft and the rebound characteristics are degraded, or the compatibility with the ionomer resin is degraded and the durability is degraded.

The composition for the cover 3 used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core 4 with the cover 3 is not specifically limited, but may be a conventional method. For example, there can be used a method comprising molding the cover composition into a semi-spherical half-shell in advance, covering the core, which is covered with the outer core, with the two half-shells, followed by pressure molding at 130 to 170° C. for 1 to 5 minutes, or a method comprising injection molding the cover composition directly on the core, which is covered with the core, to cover it. At the time of molding the cover, many depressions called "dimples" may be optionally formed on the surface of the golf ball. Furthermore, paint finishing or marking with a stamp may be optionally provided after the cover molded for commercial purposes.

EXAMPLES

The following Examples and Comparative Examples further illustrate the present invention in detail but are not to be construed to limit the scope of the present invention.

(i) Production of Unvulcanized Inner Core

The rubber compositions for the inner core having the formulation shown in Tables 1 and 2 (Examples) and Table 3 (Comparative Examples) were mixed, and then extruded to obtain cylindrical unvulcanized plugs.

(ii) Production of Vulcanized Semi-Spherical Half-Shell for the Outer Core

The rubber compositions for the outer core having the formulation shown in Tables 1 and 2 (Examples) and Table 3 (Comparative Examples) were mixed, and then vulcanized by press-molding at the vulcanization condition shown in the same Tables in the mold (5, 6) as described in FIG. 2 to obtain vulcanized semi-spherical half-shells 7 for the outer core.

(iii) Production of Core

The unvulcanized plugs 9 for the inner core produced in the step (i) were covered with the two vulcanized semi-spherical half-shells 7 for the outer core produced in the step (ii), and then vulcanized by press-molding at the vulcanization condition shown in Tables 1 and 2 (Examples) and Table 3 (Comparative Examples) in the mold 8 as described in FIG. 3 to obtain cores 4 having a two-layered structure. A surface hardness in JIS-C hardness of the resulting core 4 was measured. The results are shown in Tables 6 and 7 (Examples) and Table 8 (Comparative Examples) as a surface hardness of the outer core (c). The diameter, center hardness (a) and surface hardness (b) of the inner core, and the thickness of the outer core were also measured, and the hardness difference (b−a) and (c−b) were calculated. The results are shown in the same Tables.

TABLE 1

(parts by weight)

| Core composition | Example No. 1 | 2 | 3 | 4 | 5 | 6 |
|---|---|---|---|---|---|---|
| (Inner core composition) | | | | | | |
| BR-18 *1-1 | 100 | 100 | 100 | 100 | 100 | 100 |
| Zinc acrylate | 27 | 27 | 27 | 27 | 27 | 25 |
| Zinc oxide | 19.2 | 19.2 | 19.2 | 19.2 | 19.2 | 19.9 |
| Dicumyl peroxide | 0.6 | 0.6 | 0.6 | 0.6 | 0.6 | 0.6 |
| Diphenyl disulfide | 0.5 | 0.5 | 0.5 | 0.5 | 0.5 | 0.5 |
| (Outer core composition) | | | | | | |
| BR-10 *1-2 | 20 | 20 | 20 | 20 | 20 | 20 |
| BR-11 *1-3 | 80 | 80 | 80 | 80 | 80 | 80 |
| Magnesium methacrylate | 25 | 25 | 25 | — | 25 | 25 |
| Trimethylolpropane triacrylate | — | — | — | — | — | — |
| Magnesium oxide | 23 | 23 | 23 | — | 23 | 23 |
| Zinc acrylate | — | — | — | 15 | — | — |
| Zinc oxide | — | — | — | 30 | — | — |
| Dicumyl peroxide | 2.0 | 2.0 | 2.0 | 1.3 | 2.0 | 2.0 |
| Tungsten | 54.5 | 54.5 | 54.5 | 21.3 | 54.5 | 54.5 |
| Vulcanization condition: temperature(° C.) × time(min) | | | | | | |
| Outer core | | | | | | |
| (° C.) | 150 | 150 | 150 | 145 | 150 | 150 |
| (min) | 5 | 5 | 5 | 5 | 5 | 5 |
| Core | | | | | | |

TABLE 1-continued (parts by weight)

| Core composition | Example No. 1 | 2 | 3 | 4 | 5 | 6 |
|---|---|---|---|---|---|---|
| The first stage | | | | | | |
| (° C.) | 150 | 150 | 150 | 150 | 150 | 150 |
| (min) | 25 | 25 | 25 | 25 | 25 | 25 |
| The second stage | | | | | | |
| (° C.) | 165 | 165 | 165 | 165 | 165 | 165 |
| (min) | 8 | 8 | 8 | 8 | 8 | 8 |

TABLE 2

(parts by weight)

| Core composition | Example No. 7 | 8 | 9 | 10 | 11 | 12 |
|---|---|---|---|---|---|---|
| (Inner core composition) | | | | | | |
| BR-18 *1-1 | 100 | 100 | 100 | 100 | 100 | 100 |
| Zinc acrylate | 30 | 27 | 27 | 27 | 27 | 27 |
| Zinc oxide | 17.4 | 19.2 | 19.2 | 19.2 | 19.2 | 19.2 |
| Dicumyl peroxide | 0.6 | 0.6 | 0.6 | 0.6 | 0.6 | 0.6 |
| Diphenyl disulfide | 0.5 | 0.5 | 0.5 | 0.5 | 0.5 | 0.5 |
| (Outer core composition) | | | | | | |
| BR-10 *1-2 | 20 | 20 | 20 | 20 | 20 | 20 |
| BR-11 *1-3 | 80 | 80 | 80 | 80 | 80 | 80 |
| Magnesium methacrylate | 25 | 25 | 25 | 10 | 25 | 25 |
| Trimethylolpropane triacrylate | — | — | — | — | — | — |
| Magnesium oxide | 23 | 23 | 23 | 23 | 23 | 23 |
| Zinc acrylate | — | — | — | — | — | — |
| Zinc oxide | — | — | — | — | — | — |
| Dicumyl peroxide | 2.0 | 2.0 | 2.0 | 1.3 | 2.0 | 2.0 |
| Tungsten | 54.5 | 54.5 | 54.5 | 49.5 | 54.5 | 54.5 |
| Vulcanization condition: temperature(° C.) × time(min) | | | | | | |
| Outer core | | | | | | |
| (° C.) | 150 | 150 | 150 | 150 | 150 | 150 |
| (min) | 5 | 5 | 5 | 5 | 5 | 5 |
| Core | | | | | | |
| The first stage | | | | | | |
| (° C.) | 150 | 160 | 140 | 150 | 150 | 150 |
| (min) | 25 | 15 | 30 | 25 | 25 | 25 |
| The second stage | | | | | | |
| (° C.) | 165 | 165 | 165 | 165 | 165 | 165 |
| (min) | 8 | 8 | 8 | 8 | 8 | 8 |

TABLE 3

(parts by weight)

| Core composition | Comparative Example No. 1 | 2 | 3 | 4 |
|---|---|---|---|---|
| (Inner core composition) | | | | |
| BR-18 *1-1 | 100 | 100 | 100 | 100 |
| Zinc acrylate | 27 | 21 | 27 | 24 |
| Zinc oxide | 19.2 | 21.7 | 19.2 | 20.3 |
| Dicumyl peroxide | 0.6 | 0.6 | 0.6 | 0.6 |
| Diphenyl disulfide | 0.5 | 0.5 | 0.5 | 0.5 |

TABLE 3-continued (parts by weight)

| Core composition | Comparative Example No. 1 | 2 | 3 | 4 |
|---|---|---|---|---|
| (Outer core composition) | | | | |
| BR-10 *1-2 | 20 | 20 | 20 | 20 |
| BR-11 *1-3 | 80 | 80 | 80 | 80 |
| Magnesium methacrylate | 25 | 45.5 | 25 | 25 |
| Trimethylolpropane triacrylate | — | 17.8 | — | — |
| Magnesium oxide | 23 | 23 | 23 | 23 |
| Dicumyl peroxide | 2.0 | 2.0 | 2.0 | 2.0 |
| Tungsten | 54.5 | 48.7 | 54.5 | 54.5 |
| Vulcanization condition: temperature(° C.) × time(min) | | | | |
| Outer core | | | | |
| (° C.) | 150 | 135 | 150 | 150 |
| (min) | 5 | 5 | 5 | 5 |
| Core | | | | |
| The first stage | | | | |
| (° C.) | 150 | 150 | 140 | 150 |
| (min) | 25 | 25 | 40 | 25 |
| The second stage | | | | |
| (° C.) | 165 | 165 | 165 | 165 |
| (min) | 8 | 8 | 8 | 8 |

*1-1: High-cis polybutadiene (trade name "BR-18") available from JSR Co., Ltd. (Content of 1,4-cis-polybutadiene: 96%)
*1-2: High-cis polybutadiene (trade name "BR-10") available from JSR Co., Ltd. (Content of 1,4-cis-polybutadiene: 96%)
*1-3: High-cis polybutadiene (trade name "BR-11") available from JSR Co., Ltd. (Content of 1,4-cis-polybutadiene: 96%)

(iv) Preparation of Cover Compositions

The formulation materials showed in Table 4 (Examples) and Table 5 (Comparative Examples) were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder.

TABLE 4

(parts by weight)

| Cover composition | Example No. 1 | 2 | 3 | 4 | 5 | 6 | 7 | 8 | 9 | 10 | 11 | 12 |
|---|---|---|---|---|---|---|---|---|---|---|---|---|
| Hi-milan 1555 *2 | — | — | — | — | — | — | — | — | — | — | — | — |
| Hi-milan 1605 *3 | 60 | 60 | 60 | 60 | 60 | 60 | 60 | 60 | 60 | 60 | — | 60 |
| Hi-milan 1702 *4 | — | — | — | — | — | — | — | — | — | — | — | — |
| Hi-milan 1706 *5 | 40 | 40 | 40 | 40 | 40 | 40 | 40 | 40 | 40 | 40 | — | 40 |
| Hi-milan 1855 *6 | — | — | — | — | — | — | — | — | — | — | 10 | — |
| Surlyn 8945 *7 | — | — | — | — | — | — | — | — | — | — | 46 | — |
| Surlyn 9945 *8 | — | — | — | — | — | — | — | — | — | — | 37 | — |
| Surlyn AD8542 *9 | — | — | — | — | — | — | — | — | — | — | — | — |
| Pebax 2533 *10 | — | — | — | — | — | — | — | — | — | — | 5 | — |

TABLE 4-continued (parts by weight)

| Cover composition | Example No. 1 | 2 | 3 | 4 | 5 | 6 | 7 | 8 | 9 | 10 | 11 | 12 |
|---|---|---|---|---|---|---|---|---|---|---|---|---|
| Epofriend A1010 *11 | — | — | — | — | — | — | — | — | — | — | 2 | — |

TABLE 5

(parts by weight)

| Cover composition | Comparative Example No. 1 | 2 | 3 | 4 |
|---|---|---|---|---|
| Hi-milan 1555 *2 | — | — | — | — |
| Hi-milan 1605 *3 | 60 | 60 | 60 | 60 |
| Hi-milan 1702 *4 | — | — | — | — |
| Hi-milan 1706 *5 | 40 | 40 | 40 | 40 |
| Hi-milan 1855 *6 | — | — | — | — |
| Surlyn 8945 *7 | — | — | — | — |
| Surlyn 9945 *8 | — | — | — | — |
| Surlyn AD8542 *9 | — | — | — | — |
| Pebax 2533 *10 | — | — | — | — |
| Epofriend A1010 *11 | — | — | — | — |

*2: Hi-milan 1555 (trade name), ethylene-methacrylic acid copolymer ionomer resin obtained by neutralizing with sodium ion, manufactured by Mitsui Du Pont Polychemical Co., Ltd., Shore D hardness: 61, flexural modulus: 300 MPa
*3: Hi-milan 1605 (trade name), ethylene-methacrylic acid copolymer ionomer resin obtained by neutralizing with sodium ion, manufactured by Mitsui Du Pont Polychemical Co., Ltd., Shore D hardness: 62, flexural modulus: 310 MPa
*4: Hi-milan 1702 (trade name), ethylene-methacrylic acid copolymer ionomer resin obtained by neutralizing with zinc ion, manufactured by Mitsui Du Pont Polychemical Co., Ltd., Shore D hardness: 62, flexural modulus: 150 MPa
*5: Hi-milan 1706 (trade name), ethylene-methacrylic acid copolymer ionomer resin obtained by neutralizing with zinc ion, manufactured by Mitsui Du Pont Polychemical Co., Ltd., Shore D hardness: 60, flexural modulus: 270 MPa
*6: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd., Shore D hardness: 54, flexural modulus: 87 MPa
*7: Surlyn 8945 (trade name), ethylene-methacrylic acid copolymer ionomer resin obtained by neutralizing with sodium ion, manufactured by DuPont USA Co., Shore D hardness: 63, flexural modulus: 270 MPa
*8: Surlyn 9945 (trade name), ethylene-methacrylic acid copolymer ionomer resin obtained by neutralizing with zinc ion, manufactured by Du Pont Co., Shore D hardness: 61, flexural modulus: 220 MPa
*9: Surlyn AD8542 (trade name), ethylene-methacrylic acid copolymer ionomer resin obtained by neutralizing with magnesium ion, manufactured by Du Pont Co., Shore D hardness: 44, flexural modulus: 35 MPa
*10: Pebax 2533 (trade name), polyether amide thermoplastic elastomer, manufactured by ELF Atochem Co.
*11: Epofriend AT1010 (trade name), styrene-butadiene-styrene (SBS) block copolymer with epoxy groups, manufactured by Daicel Chemical Industries, Ltd., JIS-A hardness = 67, styrene/butadiene (weight ratio) = 40/60, content of epoxy = about 1.5 to 1.7% by weight

Examples 1 to 12 and Comparative Examples 1 to 4

The cover composition was covered on the resulting core 4 having two-layered structure by injection molding to form a cover layer 3 having the thickness shown in Tables 6 and 7 (Examples) and Table 8 (Comparative Examples). Then, paint was applied on the surface to produce golf ball having a diameter of 42.7 mm. With respect to the resulting golf balls, the initial velocity, launch angle, spin amount, flight distance and shot feel were measured or evaluated. The results are shown in Tables 9 and 10 (Examples) and Table 11 (Comparative Examples). The test methods are as follows.

(Test Method)

(1) Hardness (i) JIS-C Hardness (Core)

The JIS-C hardness was measured with a JIS-C hardness meter according to JIS K 6301.

(ii) Shore D Hardness of Cover

After the golf ball is obtained by covering the core with the cover, a Shore D hardness of the cover is determined by measuring a hardness at the surface of the golf ball at 23° C. using a Shore D hardness meter according to ASTM D-2240-68.

(2) Flight Performance

A No. 1 wood club (W#1, a driver) or No. 5 iron club (I#5) was mounted to a swing robot manufactured by Golf Laboratory Co. and the resulting golf ball was hit at a head speed of 35 m/second or 30 m/second, respectively, the initial velocity, launch angle, spin amount and flight distance were measured. The spin amount was measured by continuously taking a photograph of a mark provided on the hit golf ball using a high-speed camera. As the flight distance, carry that is a distance to the dropping point of the hit golf ball was measured. The measurement was conducted by using 12 golf balls for every sample (n=12), and the average is shown as the result of the golf ball.

(3) Shot Feel

The shot feel of the resulting golf ball was evaluated by 30 golfers who swing the golf club at high head speed (not less than 43 m/second) and 30 golfers who swing the golf club at low head speed (not less than 38 m/second) according to practical hitting test using a No. 1 wood club (W#1, a driver) and No. 5 iron club (I#5), by all 60 golfers according to approach shot test using a No. 7 Iron club and sand wedge, and by all 60 golfers according to practical hitting test using a putter. The evaluation criteria are as follows. In the case of the golf ball evaluated as "Δ" and "x", the reason of the evaluation is also described.

(Evaluation Criteria)

oo: Not less than 80% golfers felt that the golf ball has low impact force, and has the rebound characteristics and good shot feel.

o: Not less than 60% and less than 80% golfers felt that the golf ball has low impact force, and has the rebound characteristics and good shot feel.

Δ: Not less than 20% and less than 60% golfers felt that the golf ball has low impact force, and has the rebound characteristics and good shot feel.

x: Less than 20% golfers felt that the golf ball has low impact force, and has the rebound characteristics and good shot feel.

H: The impact force is large and the shot feel is poor.

W: The shot feel is heavy and the rebound characteristics are poor.

TABLE 6

| | Example No. | | | | | |
|---|---|---|---|---|---|---|
| Test item | 1 | 2 | 3 | 4 | 5 | 6 |
| Diameter of inner core (mm) | 35.6 | 36.6 | 37.2 | 37.2 | 37.6 | 37.2 |
| Thickness of outer core (mm) | 1.3 | 0.8 | 0.5 | 0.5 | 0.3 | 0.5 |

TABLE 6-continued

| | Example No. | | | | | |
|---|---|---|---|---|---|---|
| Test item | 1 | 2 | 3 | 4 | 5 | 6 |
| Thickness of cover (mm) | 2.3 | 2.3 | 2.3 | 2.3 | 2.3 | 2.3 |
| Hardness of inner core (JIS-C hardness) | | | | | | |
| Center hardness (a) | 68 | 68 | 68 | 68 | 68 | 66 |
| Surface hardness (b) | 78 | 78 | 78 | 78 | 78 | 76 |
| Hardness difference (b − a) | 10 | 10 | 10 | 10 | 10 | 10 |
| Hardness of outer core (JIS-C hardness) | | | | | | |
| Surface hardness (c) | 68 | 70 | 72 | 72 | 73 | 70 |
| Hardness difference (c − b) | −10 | −8 | −6 | −6 | −5 | −6 |
| Hardness of cover | | | | | | |
| Shore D hardness | 70 | 70 | 70 | 70 | 70 | 70 |

TABLE 7

| | Example No. | | | | | |
|---|---|---|---|---|---|---|
| Test item | 7 | 8 | 9 | 10 | 11 | 12 |
| Diameter of inner core (mm) | 37.2 | 37.2 | 37.2 | 37.2 | 37.2 | 38.0 |
| Thickness of outer core (mm) | 0.5 | 0.5 | 0.5 | 0.5 | 0.5 | 0.5 |
| Thickness of cover (mm) | 2.3 | 2.3 | 2.3 | 2.3 | 2.3 | 1.9 |
| Hardness of inner core (JIS-C hardness) | | | | | | |
| Center hardness (a) | 71 | 63 | 73 | 68 | 68 | 68 |
| Surface hardness (b) | 81 | 78 | 78 | 78 | 78 | 78 |
| Hardness difference (b − a) | 10 | 15 | 5 | 10 | 10 | 10 |
| Hardness of outer core (JIS-C hardness) | | | | | | |
| Surface hardness (c) | 75 | 72 | 72 | 63 | 72 | 72 |
| Hardness difference (c − b) | −6 | −6 | −6 | −15 | −6 | −6 |
| Hardness of cover | | | | | | |
| Shore D hardness | 70 | 70 | 70 | 70 | 66 | 70 |

| | Comparative Example No. | | | |
|---|---|---|---|---|
| Test item | 1 | 2 | 3 | 4 |
| Diameter of inner core (mm) | 34.8 | 34.2 | 37.2 | 35.0 |
| Thickness of outer core (mm) | 1.7 | 2.0 | 0.5 | 2.0 |
| Thickness of cover (mm) | 2.3 | 2.3 | 2.3 | 1.8 |
| Hardness of inner core (JIS-C hardness) | | | | |
| Center hardness (a) | 68 | 61 | 75 | 65 |
| Surface hardness (b) | 78 | 71 | 76 | 75 |
| Hardness difference (b − a) | 10 | 10 | 1 | 10 |
| Hardness of outer core (JIS-C hardness) | | | | |
| Surface hardness (c) | 66 | 88 | 70 | 64 |
| Hardness difference (c − b) | −12 | 17 | −6 | −11 |
| Hardness of cover | | | | |
| Shore C hardness | 70 | 70 | 70 | 70 |

TABLE 9

| Test item | Example No. 1 | 2 | 3 | 4 | 5 | 6 |
|---|---|---|---|---|---|---|
| Flight performance (W#1, 35 m/sec) | | | | | | |
| Initial velocity (m/sec) | 50.5 | 50.6 | 50.6 | 50.7 | 50.6 | 50.6 |
| Launch angle (degree) | 14.1 | 14.1 | 14.0 | 14.0 | 14.0 | 14.1 |
| Spin amount (rpm) | 2860 | 2810 | 2820 | 2830 | 2820 | 2780 |
| Flight distance (yard) | 164.5 | 165.2 | 165.3 | 165.4 | 164.9 | 165.2 |
| Flight performance (I#5, 30 m/sec) | | | | | | |
| Initial velocity (m/sec) | 43.7 | 43.8 | 43.8 | 43.8 | 43.8 | 43.7 |
| Launch angle (degree) | 17.2 | 17.2 | 17.3 | 17.3 | 17.3 | 17.3 |
| Spin amount (rpm) | 3650 | 3600 | 3570 | 3570 | 3560 | 3540 |
| Flight distance (yard) | 133.8 | 134.5 | 134.8 | 134.8 | 134.8 | 134.9 |
| Shot feel | | | | | | |
| W#1, at high head speed | ○ | ○○ | ○○ | ○○ | ○○ | ○○ |
| W#1, at low head speed | ○○ | ○○ | ○○ | ○○ | ○○ | ○ |
| I#5, at high head speed | ○○ | ○○ | ○○ | ○○ | ○ | ○○ |
| I#5, at low head speed | ○○ | ○○ | ○○ | ○○ | ○○ | ○○ |
| Approach and putter | ○○ | ○○ | ○○ | ○○ | ○ | ○○ |

TABLE 10

| Test item | Example No. 7 | 8 | 9 | 10 | 11 | 12 |
|---|---|---|---|---|---|---|
| Flight performance (W#1, 35 m/sec) | | | | | | |
| Initial velocity (m/sec) | 50.7 | 50.5 | 50.7 | 50.6 | 50.5 | 50.6 |
| Launch angle (degree) | 14.0 | 14.1 | 14.0 | 14.0 | 14.0 | 14.0 |
| Spin amount (rpm) | 2800 | 2760 | 2830 | 2810 | 2850 | 2820 |
| Flight distance (yard) | 165.1 | 165.0 | 164.7 | 164.9 | 164.6 | 164.9 |
| Flight performance (I#5, 30 m/sec) | | | | | | |
| Initial velocity (m/sec) | 43.9 | 43.8 | 43.8 | 43.7 | 43.6 | 43.7 |
| Launch angle (degree) | 17.2 | 17.3 | 17.2 | 17.2 | 17.2 | 17.3 |
| Spin amount (rpm) | 3600 | 3510 | 3610 | 3620 | 3600 | 3560 |
| Flight distance (yard) | 134.4 | 134.7 | 134.4 | 134.2 | 134.0 | 134.5 |

TABLE 10-continued

| Test item | Example No. 7 | 8 | 9 | 10 | 11 | 12 |
|---|---|---|---|---|---|---|
| Shot feel | | | | | | |
| W#1, at high head speed | ○ | ○ | ○ | ○ | ○ | ○○ |
| W#1, at low head speed | ○○ | ○○ | ○○ | ○○ | ○○ | ○○ |
| I#5, at high head speed | ○○ | ○○ | ○○ | ○○ | ○ | ○○ |
| I#5, at low head speed | ○○ | ○○ | ○○ | ○○ | ○○ | ○○ |
| Approach and putter | ○○ | ○○ | ○○ | ○○ | ○○ | ○○ |

TABLE 11

| Test item | Comparative Example No. 1 | 2 | 3 | 4 |
|---|---|---|---|---|
| Flight performance (W#1, 35 m/sec) | | | | |
| Initial velocity (m/sec) | 50.4 | 50.5 | 50.5 | 50.2 |
| Launch angle (degree) | 13.9 | 14.1 | 13.8 | 13.9 |
| Spin amount (rpm) | 2900 | 2870 | 2900 | 2810 |
| Flight distance (yard) | 164.1 | 164.7 | 163.2 | 163.3 |
| Flight performance (I#5, 30 m/sec) | | | | |
| Initial velocity (m/sec) | 43.5 | 43.8 | 43.3 | 43.4 |
| Launch angle (degree) | 17.0 | 17.0 | 17.1 | 17.0 |
| Spin amount (rpm) | 3700 | 3500 | 3680 | 3730 |
| Flight distance (yard) | 133.2 | 134.3 | 133.5 | 133.0 |
| Shot feel | | | | |
| W#1, at high head speed | ΔW | ΔH | xH | xW |
| W#1, at low head speed | ○ | xH | ΔH | xW |
| I#5, at high head speed | ○ | ○ | xH | xW |
| I#5, at low head speed | ○ | xH | ○ | Δ |
| Approach and putter | ○○ | xH | ○○ | ○○ |

As is apparent from the results of Tables 9 to 11, the golf balls of the present invention of Examples 1 to 12, which adjust a diameter, surface hardness and hardness distribution of the inner core, a thickness of the outer core and a hardness distribution of the core to a specified range, have very soft and good shot feel when hit by golfers who swing a golf club at high or low head speed using all golf clubs such as a driver to an iron club, a putter, and have excellent flight performance, that is, high launch angle and long flight distance, when hit by a golfer who swings a golf club at low head speed compared with the golf balls of Comparative Examples 1 to 5.

When compared with the golf balls of Examples 1, 2, 3 and 5 having the same constitution except for the thickness of the outer core, the golf ball of Example 1 having large thickness of the outer core has slightly large spin amount, which reduces the flight distance, in the golf balls of Examples having better performance than those of Comparative Examples 1 to 5. The golf ball of Example 4 using zinc acrylate as a co-crosslinking agent for the outer core composition has performance as excellent as the golf ball of Example 3 using magnesium methacrylate, but has poor releasability from a mold.

On the other hand, in the golf ball of Comparative Example 1, the shot feel when hit by golfers who swing a golf club at high head speed using a driver is heavy and poor, and the spin amount is large, which reduces the flight distance, because the thickness of the outer core is large.

In the golf ball of Comparative Example 2, the shot feel is hard and poor, because the thickness of the outer core is large. In addition, the shot feel is hard and poor when hit particularly by a short iron club and putter, because the surface hardness of the outer core is higher than that of the inner core.

In the golf ball of Comparative Example 3, the shot feel is hard and poor and the launch angle is small, which reduces the flight distance, because the difference between the center hardness and surface hardness of the inner core.

In the golf ball of Comparative Example 4, the shot feel is heavy and poor, the rebound characteristics are degraded, and the spin amount is large, which reduces the flight distance, because the thickness of the outer core is large.

What is claimed is:

1. A multi-piece solid golf ball comprising a core consisting of an inner core and an outer core formed on the inner core, and one or more layers of cover covering the core, wherein the inner core has a diameter of 30 to 40.4 mm, a surface hardness in JIS-C hardness of 60 to 85, and a center hardness in JIS-C hardness of the inner core is lower than the surface hardness by 5 to 30, and the outer core has a thickness of 0.2 to 0.9 mm, and a surface hardness in JIS-C hardness of the outer core is lower than the surface hardness of the inner core by 2 to 30, wherein the outer core is formed from a rubber composition comprising not less than 40% of a cis-1,4 bond polybutadiene, a co-crosslinking agent, an organic peroxide and a filler.

2. The multi-piece solid golf ball according to claim 1, wherein the co-crosslinking agent for the outer core is magnesium methacrylate.

3. The multi-piece solid golf ball according to claim 1, wherein the outermost layer of the cover has a thickness of 1.0 to 3.0 mm and a surface hardness in Shore D hardness of 58 to 75.

4. The multi-piece solid golf ball according to claim 1, wherein the cross-linking agent for the inner core is zinc acrylate.

5. The multi-piece solid golf ball according to claim 1, wherein the inner core has a diameter of 35.6 to 40.4 mm.

6. The multi-piece solid golf ball according to claim 1, wherein the inner core has a diameter of 35.6 to 38.6 mm.

7. The multi-piece solid golf ball according to claim 1, wherein the inner core has a surface hardness in JIS-C hardness of 70 to 84.

8. The multi-piece solid golf ball according to claim 1, wherein the inner core has a surface hardness in JIS-C hardness of 72 to 82.

9. The multi-piece solid golf ball according to claim 1, wherein the center hardness in JIS-C hardness of the inner core is lower than the surface hardness by 6 to 20.

10. The multi-piece solid golf ball according to claim 1, wherein the center hardness in JIS-C hardness of the inner core is lower than the surface hardness by 7 to 15.

11. The multi-piece solid golf ball according to claim 1, wherein the inner core has a center hardness in JIS-C hardness of 50 to 80.

12. The multi-piece solid golf ball according to claim 1, wherein the outer core has a thickness of 0.3 to 0.8 mm.

13. The multi-piece solid golf ball according to claim 1, wherein the surface hardness of the outer core is lower than the surface hardness of the inner core by 4 to 30.

14. The multi-piece solid golf ball according to claim 1, wherein the surface hardness of the outer core is lower than the surface hardness of the inner core by 5 to 30.

15. The multi-piece solid golf ball according to claim 1, wherein the surface hardness of the outer core is lower than the surface hardness of the inner core by 5 to 15.

16. The multi-piece solid golf ball according to claim 1, wherein the outer core has a surface hardness in JIS-C hardness of 83 to 50.

17. The multi-piece solid golf ball according to claim 1, wherein the outer core has a surface hardness in JIS-C hardness of 80 to 60.

18. A multi-piece solid golf ball comprising a core consisting of an inner core and an outer core formed on the inner core, and one or more layers of cover covering the core, wherein the inner core has a diameter of 35.6 to 40.4 mm, a surface hardness in JIS-C hardness of 60 to 85, and a center hardness in JIS-C hardness of the inner core is lower than the surface hardness by 5 to 30, and the outer core has a thickness of 0.2 to 1.3 mm, and a surface hardness in JIS-C hardness of the outer core is lower than the surface hardness of the inner core by 2 to 30, wherein the outer core is formed from a rubber composition comprising not less than 40% of a cis-1,4 bond polybutadiene, a co-crosslinking agent, an organic peroxide and a filler.

19. The multi-piece solid golf ball according to claim 18, wherein the co-crosslinking agent for the outer core is magnesium methacrylate.

20. The multi-piece solid golf ball according to claim 18, wherein the outer core has a thickness of 0.2 to 0.9 mm.

21. The multi-piece solid golf ball according to claim 18, wherein the outermost layer of the cover has a thickness of 1.0 to 3.0 mm and a surface hardness in Shore D hardness of 58 to 75.

22. The multi-piece solid golf ball according to claim 18, wherein the cross-linking agent for the inner core is zinc acrylate.

23. The multi-piece solid golf ball according to claim 18, wherein the inner core has a diameter of 35.6 to 38.6 mm.

24. The multi-piece solid golf ball according to claim 18, wherein the inner core has a surface hardness in JIS-C hardness of 70 to 84.

25. The multi-piece solid golf ball according to claim 18, wherein the inner core has a surface hardness in JIS-C hardness of 72 to 82.

26. The multi-piece solid golf ball according to claim 18, wherein the center hardness in JIS-C hardness of the inner core is lower than the surface hardness by 6 to 20.

27. The multi-piece solid golf ball according to claim 18, wherein the center hardness in JIS-C hardness of the inner core is lower than the surface hardness by 7 to 15.

28. The multi-piece solid golf ball according to claim 18, wherein the inner core has a center hardness in JIS-C hardness of 50 to 80.

29. The multi-piece solid golf ball according to claim 18, wherein the outer core has a thickness of 0.3 to 0.8 mm.

30. The multi-piece solid golf ball according to claim 18, wherein the surface hardness of the outer core is lower than the surface hardness of the inner core by 4 to 30.

31. The multi-piece solid golf ball according to claim 18, wherein the surface hardness of the outer core is lower than the surface hardness of the inner core by 5 to 30.

32. The multi-piece solid golf ball according to claim 18, wherein the surface hardness of the outer core is lower than the surface hardness of the inner core by 5 to 15.

33. The multi-piece solid golf ball according to claim 18, wherein the outer core has a surface hardness in JIS-C hardness of 83 to 50.

34. The multi-piece solid golf ball according to claim 18, wherein the outer core has a surface hardness in JIS-C hardness of 80 to 60.

* * * * *